US007248816B2

(12) United States Patent
Baek

(10) Patent No.: US 7,248,816 B2
(45) Date of Patent: Jul. 24, 2007

(54) PHOTOSENSITIVE UNIT AND ELECTROPHOTOGRAPHIC IMAGE FORMING APPARATUS INCLUDING THE SAME

(75) Inventor: Chung-guk Baek, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 127 days.

(21) Appl. No.: 11/098,547

(22) Filed: Apr. 5, 2005

(65) Prior Publication Data

US 2005/0238386 A1 Oct. 27, 2005

(30) Foreign Application Priority Data

Apr. 22, 2004 (KR) ..... 10-2004-0027771

(51) Int. Cl.
*G03G 21/18* (2006.01)

(52) U.S. Cl. ..... 399/114

(58) Field of Classification Search ..... 399/111, 399/114, 116, 117
See application file for complete search history.

(56) References Cited

U.S. PATENT DOCUMENTS 5,083,158 A * 1/1992 Kashima et al. ..... 399/114
5,231,453 A * 7/1993 Nakai et al. ..... 399/114
5,697,017 A * 12/1997 Rooke et al. ..... 399/114 X
6,002,896 A * 12/1999 Miyamoto et al. ..... 399/114
6,038,415 A * 3/2000 Nishi et al. ..... 399/111
6,470,159 B2 * 10/2002 Dycher ..... 399/114

FOREIGN PATENT DOCUMENTS

| | | |
|---|---|---|
| JP | 08-220939 | 8/1996 |
| JP | 2000-147980 | 5/2000 |
| KR | P1992-0006794 | 4/1992 |
| KR | P1997-0012412 | 4/1997 |

* cited by examiner

*Primary Examiner*—Sandra L. Brase
(74) *Attorney, Agent, or Firm*—Roylance, Abrams, Berdo & Goodman, L.L.P.

(57) ABSTRACT

A photosensitive unit for an electrophotographic image forming apparatus includes a photosensitive medium, and a frame supporting the photosensitive medium. A cover covers an exposed portion of an outer circumference of the photosensitive medium that is not covered by the frame. Additionally, the image forming apparatus includes a photosensitive medium on which an electrostatic latent image is formed. Developing units develop the electrostatic latent image into visible images by supplying developers onto the electrostatic latent image of the photosensitive medium. The visible image is transferred onto a transfer medium. A photosensitive unit includes the photosensitive medium, a frame supporting the photosensitive medium, and a cover covering an exposed portion of an outer circumference of the photosensitive medium that is not covered by the frame.

22 Claims, 5 Drawing Sheets

PHOTOSENSITIVE UNIT AND ELECTROPHOTOGRAPHIC IMAGE FORMING APPARATUS INCLUDING THE SAME

CROSS REFERENCE TO RELATED APPLICATIONS

This application claims the benefit under 35 U.S.C. §119 (a) Korean Patent Application No. 10-2004-0027771, filed on Apr. 22, 2004, in the Korean Intellectual Property Office, the entire disclosure of which is hereby incorporated by reference.

BACKGROUND OF THE INVENTION

1. Field of the Invention

The present invention relates to an electrophotographic image forming apparatus. More particularly, the present invention relates to a photosensitive unit having a cover that covers an exposed portion of a photosensitive medium and an electrophotographic image forming apparatus including the photosensitive unit.

2. Description of the Related Art

Generally, an electrophotographic image forming apparatus forms an electrostatic latent image by scanning lights on a photosensitive medium that is charged to a predetermined potential. The electrostatic latent image is developed with a toner using a developing unit. The developed image is transferred and fused on a sheet of paper to print a mono-color image or a full-color image.

The electrophotographic image forming apparatus that prints the full-color image generally includes an exposure unit scanning beams of light corresponding to image information. The electrostatic latent image is formed on a photosensitive medium by the light scanned from the exposure unit. Four developing units respectively receive toners of four colors, that is, yellow (Y), magenta (M), cyan (C), and black (K) and develop the electrostatic latent image on the photosensitive medium into visible toner images. The toner image on the photosensitive medium is transferred to a transfer belt.

The developing units, the photosensitive medium, and the transfer belt are supplies that should be replaced when life spans thereof are completed. Thus these components are formed as detachable units. FIG. 1 shows an example of a conventional photosensitive medium unit.

Referring to FIG. 1, the conventional photosensitive unit 1 includes a photosensitive medium 2 having an outer circumference on which a photoconductive material is evaporation-coated. A frame 10 rotatably supports a rotary shaft 3 of the photosensitive medium 2. A handle 7 is connected to the frame 10, and a charging roller 5 evenly charges the outer circumference of the photosensitive medium 2. The electrostatic latent image is formed on the outer circumference of the photosensitive medium 2 during the printing process. The toner, that is, the developer, is supplied from the developing unit (not shown) to the electrostatic latent image to form a visible toner image. The visible toner image is transferred onto a transfer medium (not shown). Therefore, a portion 2*a* of the outer circumference of the photosensitive medium 2 facing the developing unit and a portion 2*b* facing the transfer medium are not covered by the frame 10, and, thusly, are exposed.

Since the outer circumference of the photosensitive medium 2 is exposed as described above, an optical fatigue phenomenon happens earlier. That is, sensitivity of the photoconductive material layer on the outer circumference of the photosensitive medium 2 with respect to the light is reduced. The optical fatigue phenomenon becomes worse when the photosensitive unit 1 is disposed out of the image forming apparatus, thereby resulting in a vague image being printed on the paper. In addition, if the optical fatigue phenomenon happens on the photosensitive unit 1, it may be decided that the life span of the photosensitive unit 1 is completed. Accordingly, the life span of the photosensitive unit 1 is reduced and costs for maintaining the supplies also increases since the photosensitive unit 1 should be replaced.

SUMMARY OF THE INVENTION

The present invention provides a photosensitive unit including a cover, which restricts exposure of an outer circumference of the photosensitive unit and protects the photosensitive unit, and an electrophotographic image forming apparatus including the photosensitive unit.

According to an aspect of the present invention, a photosensitive unit includes a photosensitive medium, and a frame supporting the photosensitive medium. A cover covers an exposed portion of an outer circumference of the photosensitive medium that is not covered by the frame.

The cover may be formed of a flexible film, and an end of the cover may be attached to the frame.

The exposed portion of the outer circumference of the photosensitive medium may include a first exposed portion to which a developer is supplied, and a second exposed portion to which a visible image developed by the developer is transferred.

The photosensitive unit may further include a handle being installed on the frame to be rotatable within a predetermined angle range with respect to the frame, and including a grip portion by which a user may grip the handle. A cover opening and closing unit opens and closes the cover so that the cover may cover a larger part of the exposed portion of the photosensitive medium as the handle rotates and the grip portion is separated from the frame.

The cover opening and closing unit may include a gear member, and an end portion of which is rotatably coupled to the rotary shaft of the photosensitive medium and the other end of which is connected to the cover. A first gear unit is formed on the end portion, and a second gear unit is disposed on the handle and engaged with the first gear unit.

The cover opening and closing unit may include a connecting member. An end of the connecting member is rotatably coupled to the rotary shaft of the photosensitive medium and the other end is connected to the cover. The handle rotates and pushes the connecting member so that the outer circumference of the photosensitive medium is exposed.

The cover may be elastically biased to cover the exposed portion on the outer circumference of the photosensitive medium.

According to another aspect of the present invention, an electrophotographic image forming apparatus includes a photosensitive medium on which an electrostatic latent image is formed. Developing units develop the electrostatic latent image into visible images by supplying developers onto the electrostatic latent image of the photosensitive medium. The visible image is transferred to a transfer medium. A photosensitive unit includes the photosensitive medium, and a frame supporting the photosensitive medium. A cover covers an exposed portion of an outer circumference of the photosensitive medium that is not covered by the frame.

The cover may be formed of a flexible film, and an end of the cover is attached to the frame.

The exposed portion of the outer circumference of the photosensitive medium may include a first exposed portion to which a developer is supplied, and a second exposed portion to which a visible image developed by the developer is transferred.

The photosensitive unit may include a handle being installed on the frame to be rotatable within a predetermined angle range with respect to the frame. A grip portion allows a user to grip the handle. A cover opening and closing unit opens and closes the cover so that the cover may cover a larger part of the exposed portion of the photosensitive medium as the handle rotates and the grip portion is separated from the frame.

The cover opening and closing unit may include a gear member. An end portion of the gear member is rotatably coupled to the rotary shaft of the photosensitive medium and the other end of which is connected to the cover. A first gear unit formed on the end portion, and a second gear unit is disposed on the handle and engaged with the first gear unit.

The cover opening and closing unit may include a connecting member. An end of the connecting member is rotatably coupled to the rotary shaft of the photosensitive medium and the other end of which is connected to the cover. The handle rotates and pushes the connecting member so that the outer circumference of the photosensitive medium is exposed.

The cover may be elastically biased to cover the exposed portion of the outer circumference of the photosensitive medium.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings, in which:

FIG. 4 shows the photosensitive unit with the cover closed, and FIG. 5 shows the photosensitive unit with the cover opened.

Throughout the drawings, like reference numerals will be understood to refer to like parts, components and structures.

DETAILED DESCRIPTION OF EXEMPLARY EMBODIMENTS

Hereinafter, a photosensitive unit and an electrophotographic image forming apparatus according to exemplary embodiments of the present invention will be described as follows.

Figure 1:
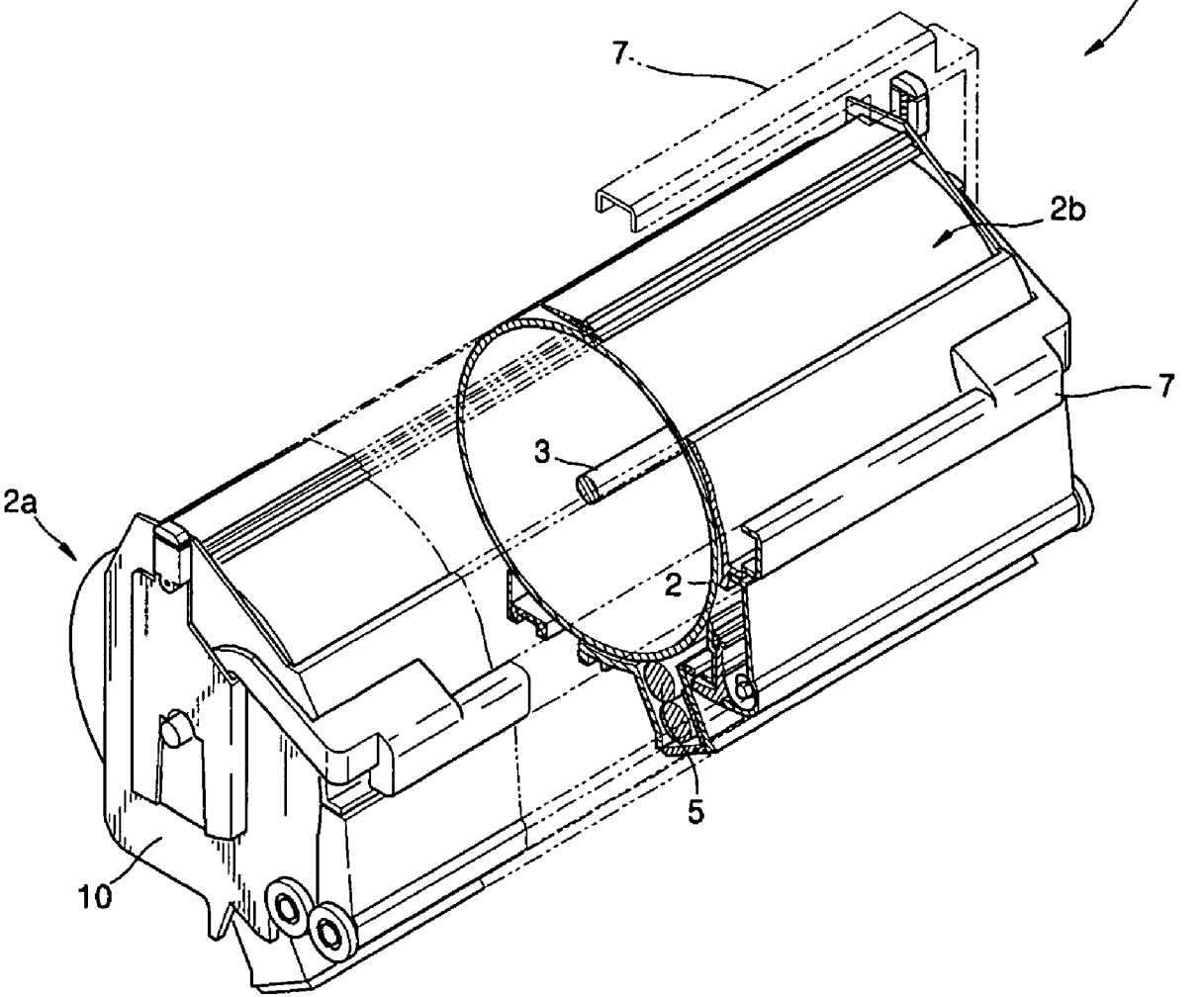
FIG. 1 (PRIOR ART)
FIG. 1 is a perspective view of a conventional photosensitive unit.
Figure 2:
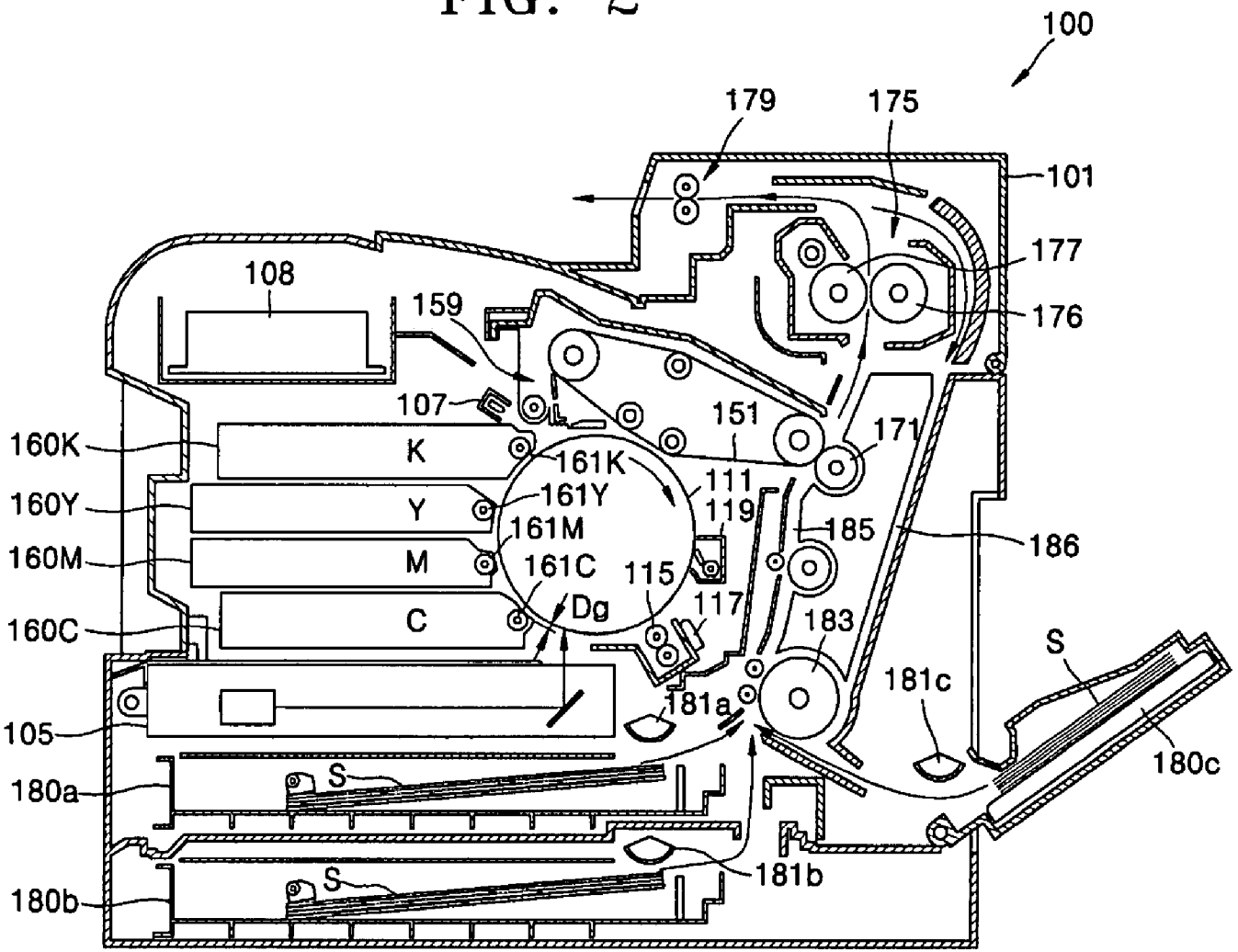
FIG. 2 is a sectional view of an electrophotographic image forming apparatus according to an exemplary embodiment of the present invention.
Figure 3:
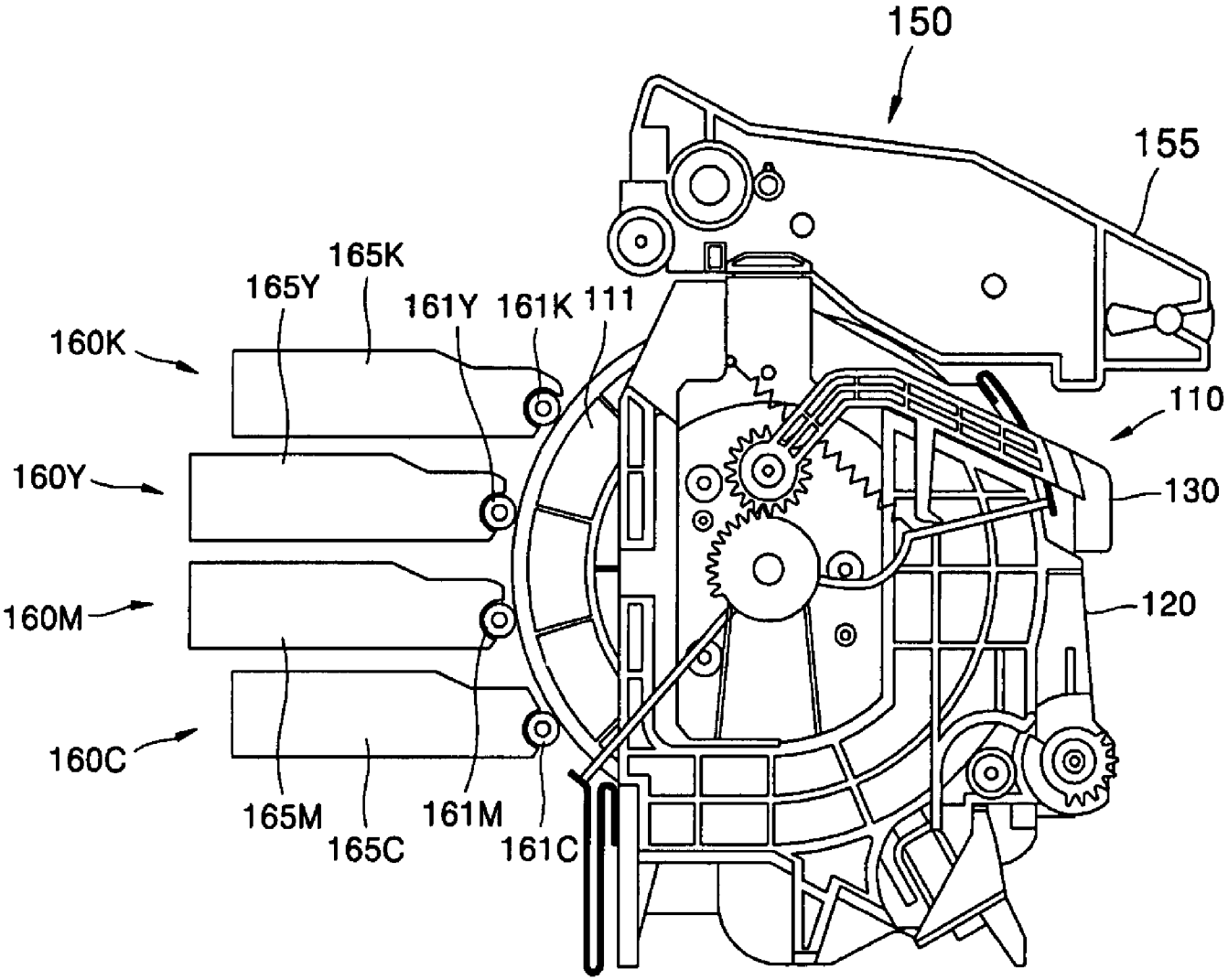
FIG. 3 is a front view of a photosensitive unit, a transfer belt unit, and a developing unit that are disposed in the electrophotographic image forming apparatus according to the present invention.
Figure 4:
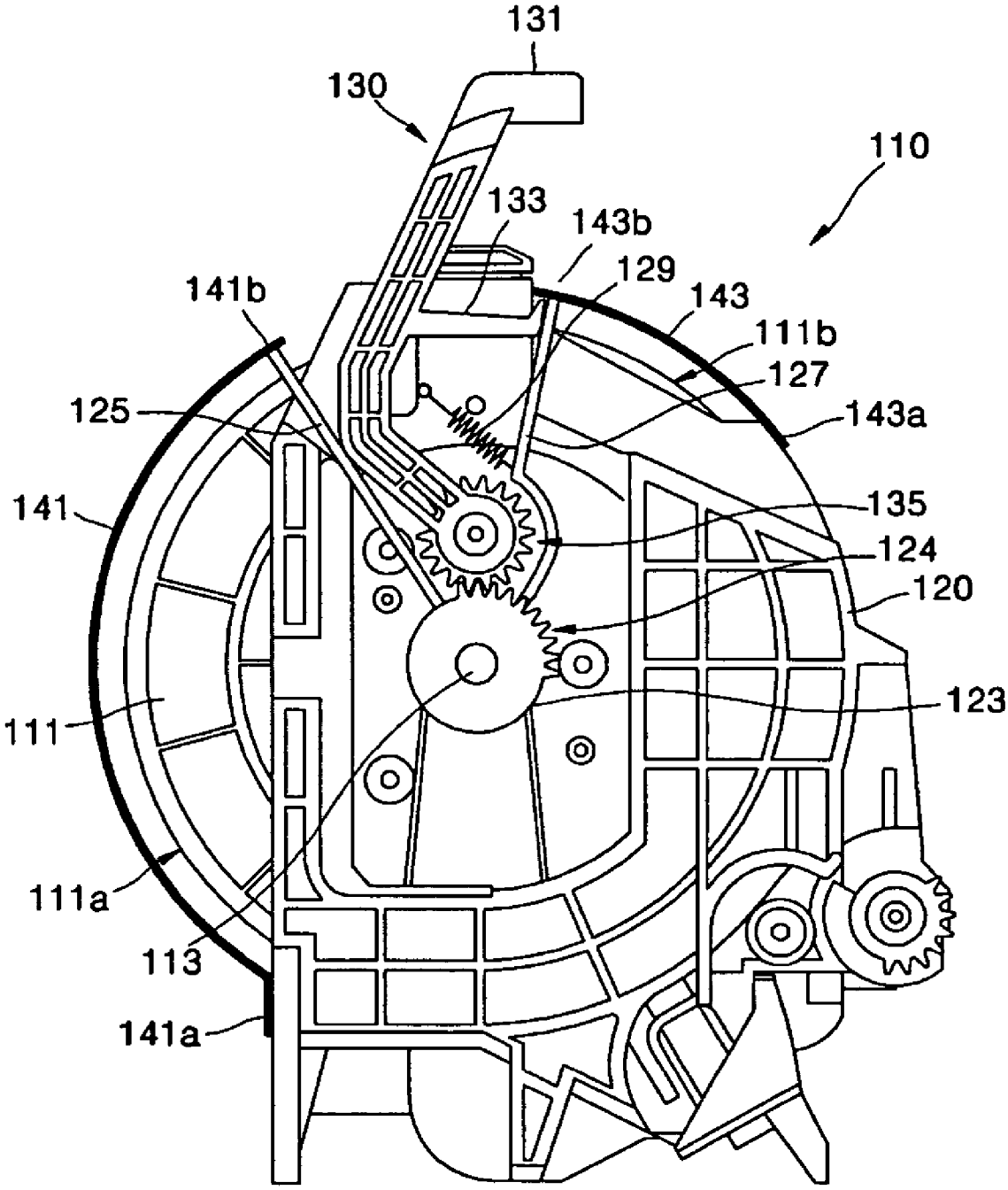
FIGS. 4 and 5 are front elevational views of the photosensitive unit according to an exemplary embodiment of the present invention, where
Figure 5:
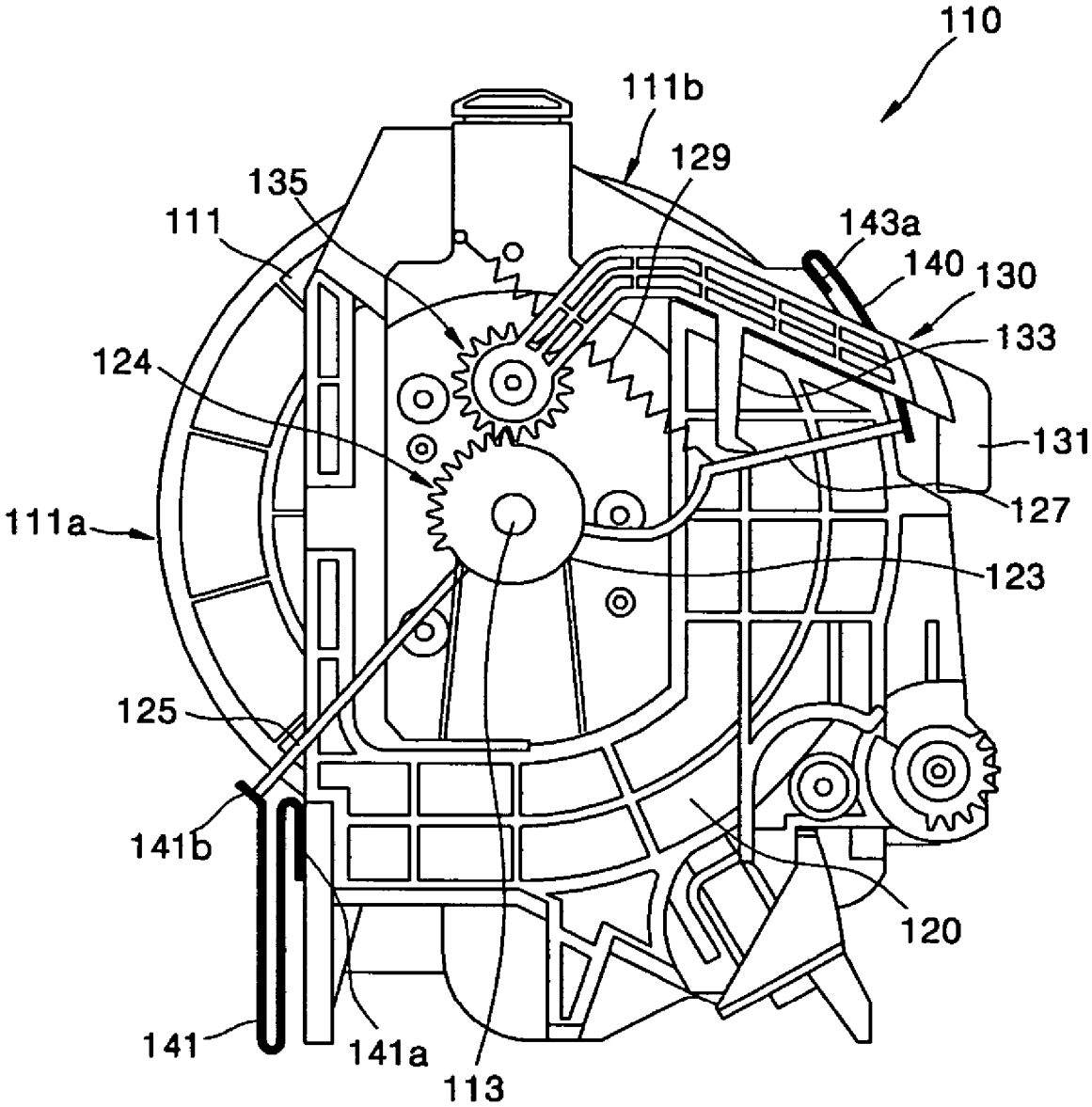

FIG. 2 is a sectional view showing an electrophotographic image forming apparatus according to an exemplary embodiment of the present invention. FIG. 3 is a front view of a photosensitive unit, a transfer belt unit, and a developing unit disposed in the electrophotographic image forming apparatus of the present invention. In addition, FIGS. 4 and 5 are front views showing the photosensitive unit according to exemplary embodiments of the present invention. FIG. 4 shows a state where a cover is closed, and FIG. 5 shows a state where the cover is opened.

Referring to FIG. 2, the electrophotographic image forming apparatus 100 according to an exemplary embodiment of the present invention includes a housing 101. A photosensitive drum 111, that is, a photosensitive medium, a charging roller 115, an exposure unit 105, four developing units 160K, 160Y, 160M and 160C, and a transfer belt 151 are disposed in the housing 101.

The photosensitive drum 111 is formed by forming a photoconductive material layer in a deposition method on an outer circumference of a metal drum having a substantially cylindrical shape. The charging roller 115 is a type of charging device that charges the photosensitive drum 111 to a predetermined potential. The charging roller 115 rotates while contacting or without contacting the outer circumference of the photosensitive drum 111 and supplies electric charges to the photosensitive drum so that the outer circumference of the photosensitive drum 111 may have an even electric potential thereon. The exposure unit 105 is installed under the photosensitive drum 111, and scans the light corresponding to image information to the photosensitive drum 111, which is charged to have uniform potential, to form an electrostatic latent image. A laser scanning unit (LSU) having a laser diode as a light source is generally used as the exposure unit.

Four developing units 160C, 160M, 160Y, and 160K respectively receive powder toners of cyan (C), magenta (M), yellow (Y), and black (K) colors, and include developing rollers 161C, 161M, 161Y, and 161K that supply the toners to the electrostatic latent image formed on the photosensitive drum 111 to form visible toner images. The four developing units 160C, 160M, 160Y, and 160K are installed so that the developing rollers 161C, 161M, 161Y, and 161K may be separated from the outer circumference of the photosensitive drum 111 by as much as a developing gap Dg. The developing gap Dg is preferably about tens~hundreds of microns (μ).

The visible toner images of C, M, Y, and K colors that are formed sequentially on the photosensitive drum 111 are transferred sequentially onto the transfer belt 151 and overlapped with each other, thus forming a full-color toner image. Generally, a length of the transfer belt 151 is substantially the same as that of paper (S) on which the full-color toner image is finally transferred, or longer.

A transfer roller 171 is formed to face the transfer belt 151. The transfer roller 171 is separated from the transfer belt 151 when the full-color toner image is transferred onto the transfer belt 151. The transfer belt 151 is then contacted by the transfer roller 171 with a predetermined pressure in order to transfer the full-color toner image onto the paper when the full-color toner image is completely transferred on the transfer belt 151.

Reference numeral 107 denotes a pre-transfer eraser. The pre-transfer eraser 107 removes the electric charges on a non-image area on which the image on the photosensitive drum 111 is not formed before the visible toner image on the photosensitive drum 111 is transferred onto the transfer belt 151. Thus, the transferring efficiency from the photosensitive drum 111 to the transfer belt 151 may be improved.

Reference numeral 117 denotes an erasing lamp. The erasing lamp 117 is a kind of eraser that removes the electric charges remaining on the outer circumference of the photosensitive drum 111 in pre-charging operation. The erasing lamp 117 scans a predetermined amount of light onto the outer circumference of the photosensitive drum 111 to remove the electric charges remaining on the surface of the photosensitive drum 111.

Reference numeral 108 denotes a power source supplier. The power source supplier 108 provides a developing bias for developing a toner image by supplying the toner from the developing unit 160 to the photosensitive drum 111. A developing bias prevents the toner from attaching to the photosensitive drum 111 from the developing unit. A first transfer bias transfers the toner image from the photosensitive drum 111 to the transfer belt 151, and a second transfer bias transfers the toner image from the transfer belt 151 to the paper. A charging bias charges the charging roller 115.

The fusing device 175 fuses the toner image that is transferred onto the paper. The fusing device 175 includes a pair of rollers 176 and 177 that rotate while engaging to each other with a predetermined pressure. The pair of rollers 176 and 177 include heating units for heating the toner image. When the paper S, on which the toner image is transferred, passes through the fusing device 175, the toner image is fused on the paper S by the heat and pressure, and then the printing operation of the image is complete.

Reference numeral 180*a* denotes a first paper feeding cassette that is a type of paper loading unit on which the paper S is mounted. The paper loading unit may further include a second paper feeding cassette 180*b* and a multipurpose feeder (MPF) 180*c*. The MPF 180*c* is mainly used to convey an overhead projector (OHP) film or a nonstandard document.

The feed roller 183 conveys the paper S drawn from the paper feeding cassette 180*a*, 180*b*, or 180*c* by pickup roller 181*a*, 181*b*, or 181*c*. Reference numeral 179 denotes a discharging roller that discharges the paper S out of the housing 101. The image forming apparatus 100 shown in FIG. 2 includes a duplex path 186 through which the paper S is guided downwardly to perform a duplex printing operation, as well as the feeding path 185 that guides the paper S upwardly from the feed roller 183 to the fusing device 175.

The paper S on which the image is printed is discharged out of the housing 101 by the discharging roller 179. To perform the duplex printing operation, the discharging roller 179 is reversely rotated, and the paper S is conveyed along the duplex path 186. Thus, the paper S is turned over so that another image may be printed on a surface of the paper S on which the image is not printed, and the overturned paper S is conveyed by the feed roller 183 through the feeding path 185 so that the image is printed on the other surface thereof.

A first cleaning device 119 removes the waste-toner that is not transferred to the transfer belt 151 and remains on the outer circumference of the photosensitive drum 111 by raking the waste-toner from the photosensitive drum 111. In addition, a second cleaning device 159 removes the waste-toner that is not transferred to the paper and remains on the transfer belt 151 by raking the waste-toner from the transfer belt 151. The waste-toner removed by the first and second cleaning devices 119 and 159 are received in a waste toner storage (not shown) through predetermined paths (not shown).

The photosensitive drum 111, the transfer belt 151, and the developing units 160K, 160Y, 160M and 160C should be replaced when the life spans thereof are completed. Thus these components are provided as units so as to be attached on and removed from the housing 101.

Color image information includes information about C, M, Y, and K colors. In an exemplary embodiment, the toner images of the four colors are overlapped on the transfer belt 151 in an order of C, M, Y, and K, and transferred onto the paper S, and fused on the paper S to form the full-color image.

The outer circumference of the photosensitive drum 111 is charged by the charging roller 115 to a predetermined potential. When an optical signal corresponding to the C color information is scanned by the exposure unit 105 onto the rotating photosensitive drum 111, resistance of a portion receiving the optical signal reduces and the electric charges attached on the outer circumference of the photosensitive drum 111 are removed from the photosensitive drum 111. Therefore, a potential difference is generated between the portion receiving the light and the other portion, and accordingly, the electrostatic latent image is formed on the outer circumference of the photosensitive drum 111.

When the electrostatic latent image approaches the developing unit 160C of cyan color due to the rotation of the photosensitive drum 111, the power source supplier 108 applies the developing bias to the developing roller 161C of the developing unit 160C. In addition, developing prevention biases are applied to the developing rollers 161M, 161Y, and 161K of the other developing units 160M, 160Y, and 160K. Then, the toner of cyan color crosses the developing gap Dg and is attached to the electrostatic latent image formed on the outer circumference of the photosensitive drum 111, thereby forming a toner image of cyan color.

When the toner image of cyan color approaches the transfer belt 151 due to the rotation of the photosensitive drum 111, the toner image is transferred to the transfer belt 151 by a first transfer bias or contacting pressure between the photosensitive drum 111 and the transfer belt 151.

After the toner image of cyan color is transferred on the transfer belt 151, the toner images of magenta, yellow, and black colors are transferred onto the transfer belt 151 sequentially through the above processes, and overlapped with each other.

During the above processes, the transfer roller 171 is separated from the transfer belt 151. When the full-color toner image is formed on the transfer belt 151 after transferring the toner images of four colors onto the transfer belt 151, the transfer roller 171 contacts the transfer belt 151 to transfer the full-color toner image onto the paper S.

The paper S is supplied from one of the paper feeding cassettes 180*a*, 180*b*, 180*c* so that the paper S reaches a point where the transfer belt 151 and the transfer roller 171 contact each other when the front edge portion of the full-color toner image formed on the transfer belt 151 reaches that point. When the paper S passes between the transfer belt 151 and the transfer roller 171, the full-color toner image is transferred to the paper S by a second transfer bias, and the full-color toner image is fused onto the paper S using the heat and pressure by the fusing device 175. Then the paper S is discharged and the full-color image forming operation is complete.

For the next printing operation, the first and second cleaning devices 119 and 159 remove the waste-toner remaining on the photosensitive drum 111 and the transfer belt 151 respectively, and the erasing lamp 117 removes remaining electric charges on the photosensitive drum 111 by irradiating the light onto the photosensitive drum 111.

The photosensitive drum 111, the transfer belt 151, and the developing unit 160 should be replaced when the life spans thereof are completed. Thus these components are provided as units so as to be attached on and removed from the housing 101.

Referring to FIG. 3, the photosensitive drum 111 of the photosensitive unit 110 and the transfer belt 151 (refer to FIG. 2) of the transfer belt unit 150 are respectively supported by a photosensitive unit frame 120 and a transfer belt unit frame 155, which are molding members. Also, the four developing units 160C, 160M, 160Y, and 160K include developing unit frames 165C, 165M, 165Y, and 165K that are the molding units for supporting the developing rollers 161C, 161M, 161Y, and 161K.

In a state where the units are installed in the housing (101 of FIG. 2) for performing the printing operation, the transfer belt unit 150 is located on the photosensitive unit 110, and the four developing units 160C, 160M, 160Y, and 160K are located on left side of the photosensitive unit 110. Then, the transfer belt 151 of the transfer belt unit 150 contacts the photosensitive drum 111, and the handle 130 conveying the photosensitive unit 110 is folded by the transfer belt unit frame 155. In addition, the developing rollers 161C, 161M, 161Y, and 161K in the developing units 160C, 160M, 160Y, and 160K face the photosensitive drum 111 while maintaining the developing gap Dg therebetween.

Hereinafter, the photosensitive unit 110 is described in more detail below with reference to FIGS. 4 and 5.

The photosensitive unit 110 includes a first cover 141 to cover a first exposed portion 111*a* on the photosensitive drum 111 that faces the developing rollers 161C, 161M, 161Y, and 161K during the printing operation, and a second cover 143 to cover a second exposed portion 111*b* on the photosensitive drum 111 that faces the transfer belt during the printing operation. The first and second covers 141 and 143 are formed of a flexible film, such as a vinyl resin, and are preferably opaque to block the light. End portions 141*a* and 143*a* of the covers 141 and 143 formed of the flexible film are fixedly attached on the frame 120. The other end portions 141*b* and 143*b* of the covers 141 and 143 are formed to be close or far from the end portions 141*a* and 143*a* according to the rotating direction of the handle 130. When the end portions 141*a* and 143*a* become closer to the other end portions 141*b* and 143*b*, the first and second covers 141 and 143 are opened to expose the first and second exposed portions 111*a* and 111*b*, as shown in FIG. 5. On the contrary, when the end portions 141*a* and 143*a* become far from the other end portions 141*b* and 143*b*, the first and second covers 141 and 143 are closed to cover the first and second exposed portions 111*a* and 111*b*, as shown in FIG. 4.

A first cover opening and closing unit to open and close the first cover 141 includes a gear member 123 that is rotatably coupled to a rotary shaft 113 of the photosensitive drum 111. A first gear unit 124 is disposed on an end portion of the gear member 123, and a second gear unit 135 engages the first gear unit 124 and is formed on the handle 130. The gear member 123 includes a connecting wire 125 that is connected to the end portion 141*b* of the first cover 141. The second gear unit 135 is disposed on a peripheral portion of a rotary center on the handle 130.

The handle 130 is installed on the photosensitive unit frame 120 to rotate at a predetermined angle with respect to the frame 120, and includes a grip portion 131 that is apart from the center portion thereof. As shown in FIG. 4, in a state where the handle 130 stands up, the grip portion 131 is separated from the photosensitive unit frame 120, thus the user can grasp the grip portion 131 to move the photosensitive unit 110 or install or separate the photosensitive unit 110 in or from the housing 101 (FIG. 2). On the other hand, in a stand-by state for the printing operation, the handle 130 is folded by being pushed by the transfer belt unit 150 (refer to FIG. 3), and then the grip portion 131 becomes closer to the photosensitive unit frame 120, as shown in FIG. 5.

A second cover opening and closing unit for opening and closing the second cover 143 includes a connecting member 127, one end of which is rotatably coupled to the rotary shaft 113 of the photosensitive drum 111 and the other end is connected to the end portion 143*b* of the second cover 143. A pusher 133 is disposed on the handle 130 to push the connecting member 127 when the handle 130 is folded. The connecting member 127 is connected to a coil spring 129, an end of which is coupled to the photosensitive unit frame 120. Thus the connecting member 127 is elastically biased toward the standing direction, as shown in FIG. 4. Accordingly, the second cover 143 is elastically biased to cover the second exposed portion 111*b* of the photosensitive drum 111, and the handle 130 is also elastically biased toward the standing direction thereof. In addition, the first cover 141 is connected to the handle 130 through the first cover opening and closing unit is elastically biased to cover the first exposed portion 111*a* of the photosensitive drum 111.

When the photosensitive unit 110 is mounted in the housing 101 (FIG. 2), the handle 130 rotates to be folded as shown in FIG. 5, and thus the grip portion 131 of the handle 130 becomes closer to the photosensitive unit frame 120. In addition, the pusher 133 of the handle 130 pushes the connecting member 127 to descend the end portion of the connecting member 127, and accordingly, the end portion 143*b* of the second cover 143 that is connected to the other end of the connecting member 127 is also descended to expose the second exposed portion 111*b* of the photosensitive drum 111. The first gear unit 124 of the gear member 123 that is engaged with the second gear unit 135 is rotated by the rotation of the handle 130, and when the gear member 123 rotates the end portion 141*b* of the first cover 141 that is connected to the connecting wire 125 is descended to expose the first exposed portion 111*a* of the photosensitive drum 111. Therefore, the developing rollers 161C, 161M, 161Y, and 161K in the developing units 160C, 160M, 160Y, and 160K face the first exposed portion 111*a* while maintaining the developing gap Dg (FIG. 2) therebetween, and the transfer belt 151 (refer to FIG. 2) faces the second exposed portion 111*b*.

When the photosensitive drum 111 is separated from the housing 101, the connecting member 127 rotates in an opposite direction by the elastic force of the coil spring 129, as shown in FIG. 4. Accordingly, the end portion 143*b* of the second cover 143 that is connected to the end of the connecting member 127 rises to cover the second exposed portion 111*b* of the photosensitive drum 111. At the same time, the connecting member 127 pushes the handle 130 to make the handle 130 rotate in the opposite direction, and the grip portion 131 of the handle 130 is moved away from the photosensitive unit frame 120. The first gear unit 124 of the gear member 123 that is engaged with the second gear unit 135 is rotated in the opposite direction by the rotation of the handle 130, and the end portion 141*b* of the first cover 141 that is connected to the connecting wire 125 is moved by the rotation of the gear member 123 to cover the first exposed portion 111*a* of the photosensitive drum 111.

When the photosensitive unit is separated from the image forming apparatus, the photosensitive medium is covered to block the exposure of the photosensitive medium, thereby preventing the optical fatigue of the photosensitive medium, and increasing the life span of the photosensitive medium. Therefore, the costs for replacing the photosensitive medium may be reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A photosensitive unit, comprising:

a photosensitive medium;

a frame supporting the photosensitive medium;

a cover covering an exposed portion -of an outer circumference of the photosensitive medium;

a handle rotatably installed on the frame to be rotatable within an angular range with respect to the frame, and including a grip portion adapted to be gripped by a user; and a cover opening and closing unit opens and closes the cover so that the cover covers a larger part of the exposed portion on the photosensitive medium as the handle rotates and the grip portion is moved away from the frame; and wherein the cover opening and closing unit includes a gear member rotatably coupled to a rotary shaft of the photosensitive medium.

2. The photosensitive unit of claim 1, wherein the cover is formed of a flexible film, and an end of the cover is attached to the frame.

3. The photosensitive unit of claim 1, wherein the exposed portion of the outer circumference of the photosensitive medium includes a first exposed portion to which a developer is supplied, and a second exposed portion to which a visible image that is developed by the developer is transferred.

4. The photosensitive unit of claim 1, wherein the cover opening and closing unit includes a connecting member, an end of the connecting member is rotatably coupled to the rotary shaft of the photosensitive medium and the other end of the connecting member is connected to the cover, and the handle rotates and pushes the connecting member so that the outer circumference of the photosensitive medium is exposed.

5. The photosensitive medium of claim 1, wherein the cover is elastically biased to cover the exposed portion of the outer circumference of the photosensitive medium.

6. The photosensitive unit of claim 1, wherein an end portion of the gear member is rotatably coupled to the rotary shaft of the photosensitive medium and the other end of the gear member is connected to the cover, and a first gear unit is formed on the end portion of the gear member, and a second gear unit is disposed on the handle and engaged with the first gear unit.

7. An electrophotographic image forming apparatus, comprising:

a photosensitive medium on which an electrostatic latent image is formed;

developing units developing the electrostatic latent image into visible images by supplying developers onto the electrostatic latent image of the photosensitive medium;

a transfer medium on which the visible image is transferred; and a photosensitive unit including the photosensitive medium, a frame supporting the photosensitive medium, and a cover covering an exposed portion of an outer circumference of the photosensitive medium; and a handle rotatably connected to the frame to be rotatable within an angular range with respect to the frame, a grip portion on the handle to be gripped by a user, and a cover opening and closing unit to open and close the cover to cover a larger part of the exposed portion on the photosensitive medium as the handle rotates and the grip portion is moved away from the frame;

wherein the cover opening and closing unit includes a connecting member rotatably coupled to a rotary shaft of the photosensitive medium.

8. The apparatus of claim 7, wherein the cover is formed of a flexible film, and an end of the cover is attached to the frame.

9. The apparatus of claim 7, wherein the exposed portion of the outer circumference of the photosensitive medium includes a first exposed portion to which a developer is supplied, and a second exposed portion to which a visible image that is developed by the developer is transferred.

10. The apparatus of claim 7, wherein the cover opening and closing unit includes a gear member, an end portion of gear member is rotatably coupled to the rotary shaft of the photosensitive medium and the other end of the gear member is connected to the cover, a first gear unit is formed on the end portion of the gear member, and a second gear unit is disposed on the handle and engaged with the first gear unit.

11. The apparatus of claim 7, wherein the cover is elastically biased to cover the exposed portion on the outer circumference of the photosensitive medium.

12. The apparatus of claim 7, wherein the cover has a first portion to cover a first exposed portion and a second portion to cover a second exposed portion.

13. The apparatus of claim 12, wherein the first portion and the second portions of the cover are separately formed.

14. The apparatus of claim 13, wherein the first and second portions of the cover are connected to a gear member.

15. The apparatus of claim 14, wherein the first portion of the cover is connected to the gear member by a connecting wire and the second portion of the gear member is connected to the gear member by a connecting member.

16. The apparatus of claim 15, wherein an elastic member connected to the frame is connected to the connecting member.

17. The apparatus of claim 16, wherein a pusher on the handle is adapted to engage the connecting member.

18. The apparatus of claim 7, wherein an end of the connecting member is rotatably coupled to the rotary shaft of the photosensitive medium and the other end of the connecting member is connected to the cover, and the handle rotates and pushes the connecting member so that the outer circumference of the photosensitive medium is exposed.

19. A photosensitive unit, comprising:

a photosensitive medium;

a frame supporting the photosensitive medium; and a cover covering an exposed portion of an outer circumference of the photosensitive medium, the cover having a first portion to cover a first exposed portion and a second portion to cover a second exposed portion, and one end of each of the first and second cover portions is fixed to the frame.

20. A photosensitive unit according to claim 19, wherein the first portion and the second portions of the cover are separately formed.

21. A photosensitive unit according to claim 20, wherein the first and second portions of the cover are connected to a gear member.

22. A photosensitive unit according to claim 19, wherein developer is supplied to the first exposed portion of an outer circumference of the photosensitive medium, and a visible image that is developed by the developer is transferred to the second exposed portion.

* * * * *